US009725867B2

(12) United States Patent
Van De Loo

(10) Patent No.: US 9,725,867 B2
(45) Date of Patent: Aug. 8, 2017

(54) MODULAR CONCRETE REINFORCEMENT

(75) Inventor: Paul Van De Loo, Norton Summit (AU)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 0 days.

(21) Appl. No.: 14/375,115

(22) PCT Filed: Feb. 2, 2012

(86) PCT No.: PCT/US2012/023651

§ 371 (c)(1),
(2), (4) Date: Sep. 24, 2014

(87) PCT Pub. No.: WO2013/115823

PCT Pub. Date: Aug. 8, 2013

(65) Prior Publication Data

US 2015/0275462 A1 Oct. 1, 2015

(51) Int. Cl.

| | |
|---|---|
| ***E04C 5/08*** | (2006.01) |
| ***E02D 27/08*** | (2006.01) |
| ***E04C 5/16*** | (2006.01) |
| ***E04C 5/20*** | (2006.01) |
| ***E02D 31/00*** | (2006.01) |
| ***E04C 5/00*** | (2006.01) |

(52) U.S. Cl.

CPC ..... *E02D 27/08* (2013.01); *E02D 31/00* (2013.01); *E04C 5/00* (2013.01); *E04C 5/16* (2013.01); *E04C 5/163* (2013.01); *E04C 5/20* (2013.01)

(58) Field of Classification Search

CPC . E02D 27/08; E02D 31/00; E04C 5/16; E04C 5/00

See application file for complete search history.

(56) References Cited

U.S. PATENT DOCUMENTS

| | | | | |
|---|---|---|---|---|
| 805,663 | A | 11/1905 | Peabody | |
| 2,303,394 | A * | 12/1942 | Schorer | B28B 23/04 52/223.13 |
| 2,497,058 | A | 2/1950 | Reid | |
| 2,505,152 | A | 4/1950 | Shearer | |
| 2,689,999 | A * | 9/1954 | Petersen | B28B 23/04 249/50 |
| 2,861,602 | A | 11/1958 | Thomas | |

(Continued)

FOREIGN PATENT DOCUMENTS

| | | |
|---|---|---|
| JP | 02217544 | 8/1990 |
| JP | 2008248681 | 10/2008 |

OTHER PUBLICATIONS

International Search Report and Written Opinion from International Application No. PCT/US2012/023651 mailed May 23, 2012.

(Continued)

*Primary Examiner* — Joshua J Michener
*Assistant Examiner* — Keith Minter
(74) *Attorney, Agent, or Firm* — Dorsey & Whitney LLP

(57) ABSTRACT

A reinforcement module can include a first endplate having notches, a second endplate having notches, a spacing member in contact with the first endplate and the second endplate, and wires looped around at least one of the notches of the first endplate and around at least one of the notches of the second endplate.

24 Claims, 6 Drawing Sheets

(56) References Cited

U.S. PATENT DOCUMENTS 3,041,702 A * 7/1962 Schwab ..... B28B 23/024 249/93
3,110,982 A 11/1963 Besinger
3,162,709 A * 12/1964 Davidson ..... B28B 21/62 138/176
3,225,499 A * 12/1965 Kourkene ..... B28B 23/043 264/228
3,405,490 A * 10/1968 La Marr ..... E04C 5/125 24/122.6
3,427,772 A * 2/1969 Williams ..... E04C 5/125 24/122.6
3,548,432 A * 12/1970 Durkee ..... E01D 19/14 14/18
3,948,010 A * 4/1976 Sonneville ..... B28B 23/043 238/115
3,963,056 A 6/1976 Shibuya et al.
4,398,377 A * 8/1983 Romig, Jr. ..... E04C 3/28 29/446
4,663,907 A * 5/1987 Garcia-Mansilla Ripoll ..... E04C 5/122 52/223.13
4,704,754 A * 11/1987 Bonasso ..... E01D 1/00 14/19
2008/0216445 A1* 9/2008 Langer ..... E04B 2/8647 52/745.09
2009/0007519 A1* 1/2009 Keshishian ..... E04C 2/044 52/794.1
2009/0056258 A1* 3/2009 Currier ..... E04G 9/10 52/348
2010/0132283 A1* 6/2010 Platt ..... E04B 5/04 52/223.6
2011/0252740 A1* 10/2011 Hamlin, III ..... E04D 5/146 52/741.3
2012/0233950 A1* 9/2012 Carr ..... E04B 2/8635 52/426

OTHER PUBLICATIONS

"Cavert: Other Wire Products," Accessed at http://web.archive.org/web/20110817025407/http://www.cavertwire.com/other-wire-products, Accessed on Sep. 2, 2014, pp. 2.
"Reinforcement Spacers," Accessed at http://web.archive.org/web/20110317190528/http://www.rebarprefab.com.au/reinforcement_spacers.php, accessed on Sep. 2, 2014, pp. 3.

* cited by examiner

MODULAR CONCRETE REINFORCEMENT

CROSS-REFERENCE TO RELATED APPLICATIONS

This Application is the U.S. National Stage filing under 35 U.S.C. §371 of International Application No. PCT/US2012/23651 filed on Feb. 2, 2012.

TECHNICAL FIELD

The present application generally relates to reinforcement of concrete. More specifically, the present application describes a reinforcement module that can be used as reinforcement in concrete.

BACKGROUND

Concrete is a widely-used construction material. Concrete typically has good characteristics for withstanding compressive forces. However, concrete typically has poor tensile strength, limiting the ways in which it can be used. Concrete can be reinforced using reinforcement materials, such as reinforcement bars, reinforcement grids, plates, fibers, and other materials. The reinforcement materials typically are added to improve tensile strength. Reinforced concrete can be used in a number of construction components, such as slabs, walls, beams, columns, foundations, frames, and other components.

One difficulty with reinforcing concrete is that reinforcement materials typically must be arranged within an area prepared for a concrete pour, and the preparation of reinforcement materials within an area prepared for a concrete pour can be difficult and time consuming. Frequently, reinforcement materials, such as reinforcement bars, need to be held in place in a particular configuration prior to the concrete being poured. Furthermore, the reinforcement materials frequently need to be located inside of the external surfaces of the poured concrete. After the concrete is poured, the reinforcement materials need to maintain this position suspended within the concrete until the concrete is sufficiently cured to hold the reinforcement materials in place.

SUMMARY

In some embodiments, a reinforcement module can include a first endplate having notches, a second endplate having notches, a spacing member in contact with the first endplate and the second endplate, and wires looped around at least one of the notches of the first endplate and around at least one of the notches of the second endplate. Concrete can be poured by preparing an area for a concrete pour, acquiring a reinforcement module, placing the reinforcement module in the area, and pouring concrete in the area to substantially cover the reinforcement module.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The following figures are included in the accompanying drawings.

DETAILED DESCRIPTION

Figure 1:
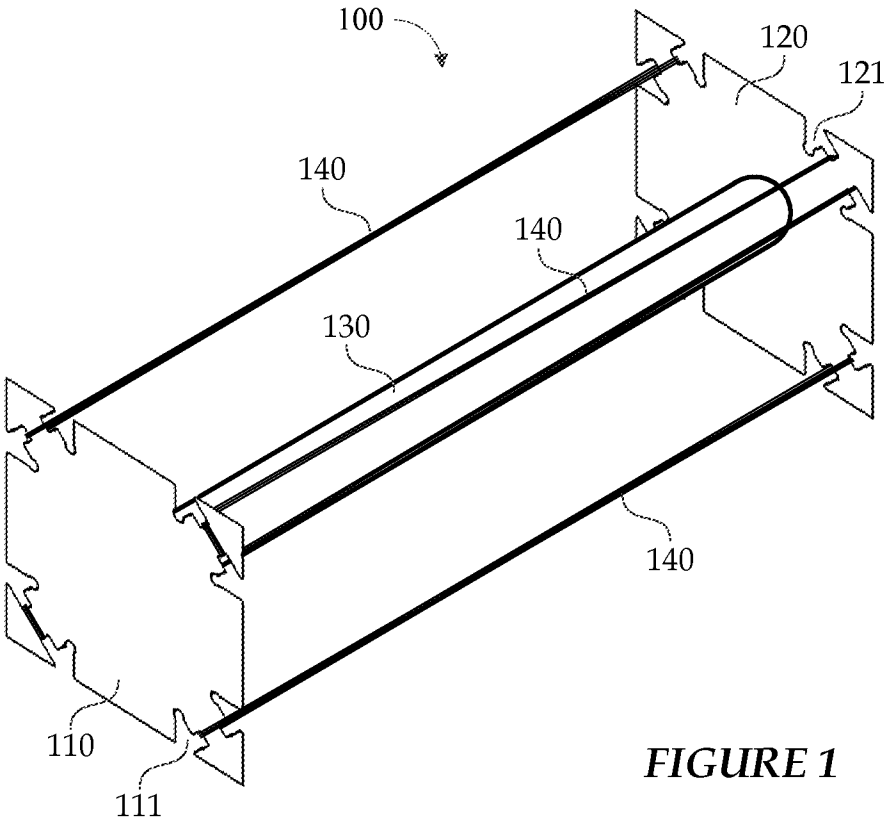
FIG. 1 depicts an illustrative embodiment of a reinforcement module.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Referring to FIG. 1, depicted is an illustrative embodiment of a reinforcement module 100. Reinforcement module 100 includes an endplate 110 that has a number of notches 111. Reinforcement module 100 also includes an endplate 120 that has a number of notches 121. Endplates 110 and 120 can have any size or shape, including rectangular (as shown in the embodiment of FIG. 1), triangular, circular, ovular, irregular, or any other type of shape. Endplates 110 and 120 can be made out of any type of material, including steel, plastic, wood, and the like. In some embodiments, endplates 110 and 120 can be made of a recycled material, such as recycled plastic. Notches 111 and 121 can take any number of forms, as is discussed in more detail below.

Endplates 110 and 120 are held apart by a spacing member 130, and endplates 110 and 120 are connected by wires 140. As depicted in FIG. 1, wires 140 can be looped around a notch in endplate 110 (e.g., notch 111 in endplate 110) and around a notch in endplate 120 (e.g., notch 121 in endplate 120). The combination of the tension force in wires 140 and the spacing member 130 holding endplates 110 and 120 apart can hold the entire module 100. Spacing member 130 need not be attached to endplate 110 and/or endplate 120. However, spacing member 130 can be attached to one or both of endplates 110 and 120, such as via one or more fasteners, welds, screws, or rivets, or via an adhesive, such as glue or epoxy. When fabricating reinforcement module 100, it may be beneficial to first attach spacing member 130 to one or both of endplates 110 and 120 before looping wires 140 around endplates 110 and 120. After the wires 140 are looped around endplates 110 and 120, the ends of wires 140 can be joined to each other or terminated in some other fashion.

Reinforcement module 100 can be used to reinforce concrete. An area can be prepared for a concrete pour. For example, a trench can be dug for pouring a concrete footing, a molding can be created for pouring a concrete column, or the like. Traditionally, a particular configuration of reinforcement materials would be arranged within the prepared area as reinforcement for concrete to be poured in the area. For example, in some trenches, reinforcement bars would be placed lengthwise in the trench with the reinforcement bars separated by a spacer that holds the reinforcement bars in a particular arrangement within the middle of the trench. After the reinforcement bars are properly placed, the trench can be filled with concrete to substantially cover the reinforcement bars. When the concrete is cured, the reinforcement bars would bear tension loads in the concrete structure. Reinforcement bars typically have an uneven or rough surface which creates friction between the reinforcement bars and the cured concrete so that any tension loads in the concrete would be transferred to the reinforcement bars. Instead of using traditional reinforcement materials, reinforcement module 100 can be used as reinforcement materials for a concrete pour. Reinforcement module 100 can be placed in an area prepared for a concrete pour and concrete can be poured to substantially cover reinforcement module 100. After the concrete is set, wires 140 of reinforcement module 100 will bear tension loads in the concrete structure. Wires 140 may not have the same surface roughness or unevenness that reinforcement bars typically have. However, when the concrete is set, a loop of wire 140 will have some concrete captured in the space between the loop. The captured concrete resists any relative motion between the cured concrete and wires 140. To increase the resistance of relative motion between cured concrete and wires 140, wires 140 can include one or more friction elements (not depicted), such as barbs, surface roughness, or other elements that increase friction.

Reinforcement module 100 can be fabricated in a number of different locations and times. In one example, reinforcement module 100 can be fabricated at the site where the concrete is to be poured. Constructing reinforcement module 100 at the concrete pour site may be advantageous in that the sizes of endplates 110 and 120 and the length of spacing member 130 can be chosen based on the particular area where concrete module 100 is to be used. In another example, reinforcement module 100 may be fabricated off of the construction pour site and available as an off-the-shelf type product. Fabricating reinforcement module 100 off of the construction pour site may be advantageous where reinforcement module 100 is to be used in a standard-sized concrete pour area. For example, there may be a standard size of trench that is used as a footing for concrete slab foundations. With standard size trenches, a manufacturer could construct a number of reinforcement modules 100 to fit the standard size trenches and the reinforcement modules 100 could be brought to the concrete pour site pre-fabricated for the particular standard-sized concrete pour area. The ability to form a reinforcement module outside of the concrete pour area and then place the reinforcement module in the concrete pour area can save time and expense in the preparation of the concrete pour area.

Figure 2:
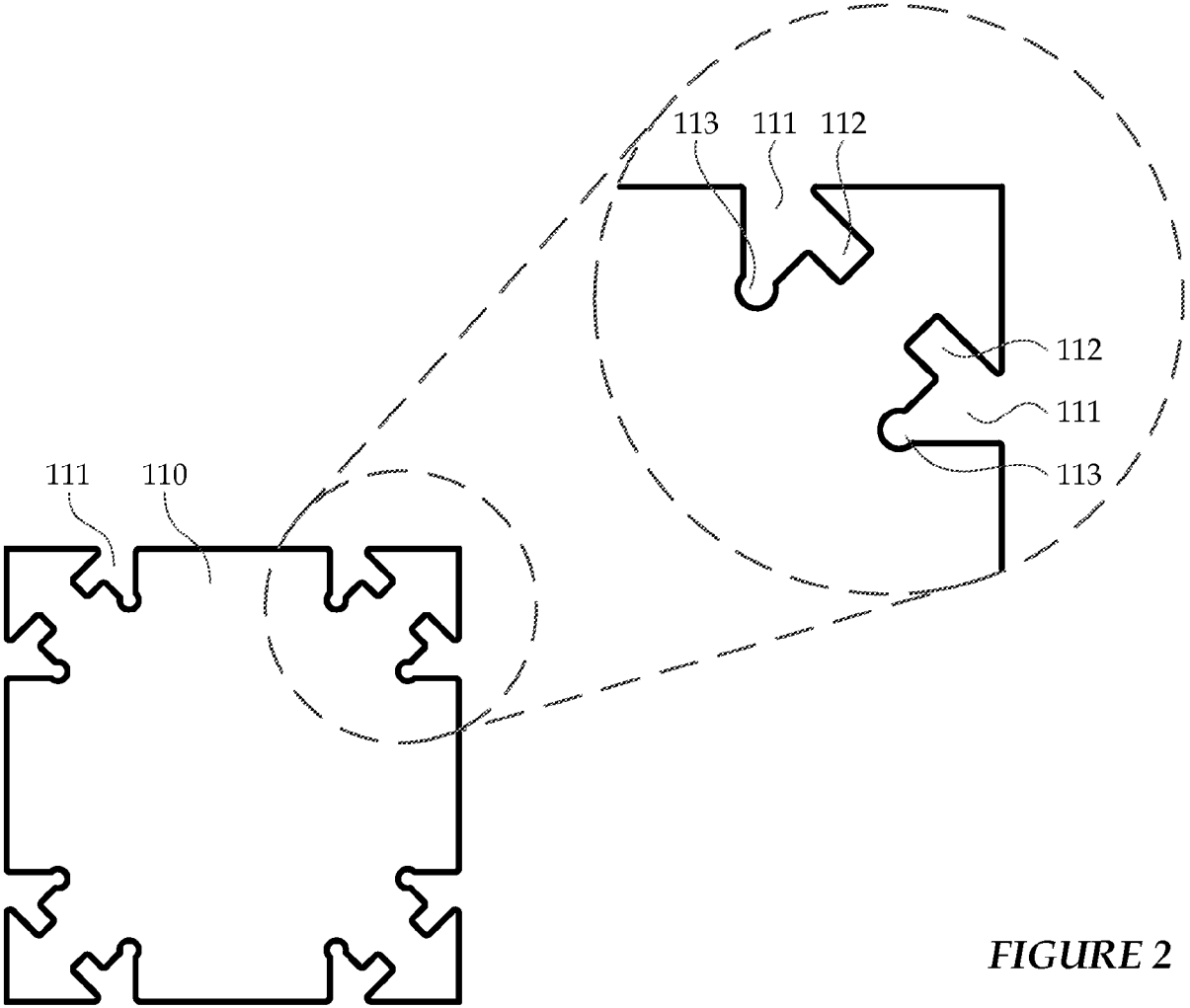
FIG. 2 depicts an illustrative embodiment of an endplate of a reinforcement module.

Referring now to FIG. 2, depicted is an illustrative embodiment of endplate 110 of a reinforcement module. Endplate 110 has a number of notches 111. Notches 111 can be used to loop a wire or wires around endplate 110. In one example, notches 111 can include wire notches 112 which are configured to guide a wire looping around endplate 110. Notches 111 can also be used to connect one reinforcement module to another, as is discussed in greater detail below. In one example, notches 111 can include reinforcement bar notches 113 which may be configured to hold a reinforcement bar. A reinforcement bar may be held at one end by a reinforcement bar notch, such as, by way of example, reinforcement bar notch 113, and held at another end by a corresponding reinforcement bar notch in another reinforcement module, as is discussed more fully with respect to FIG. 4 below. While the depiction in FIG. 2 shows one embodiment of notches in endplate 110, endplate 120 shown in FIG. 1 and any other embodiment of an endplate can have notches similar to notches 111, wire notches 112, and reinforcement bar notches 113 of endplate 110.

Figure 3A:
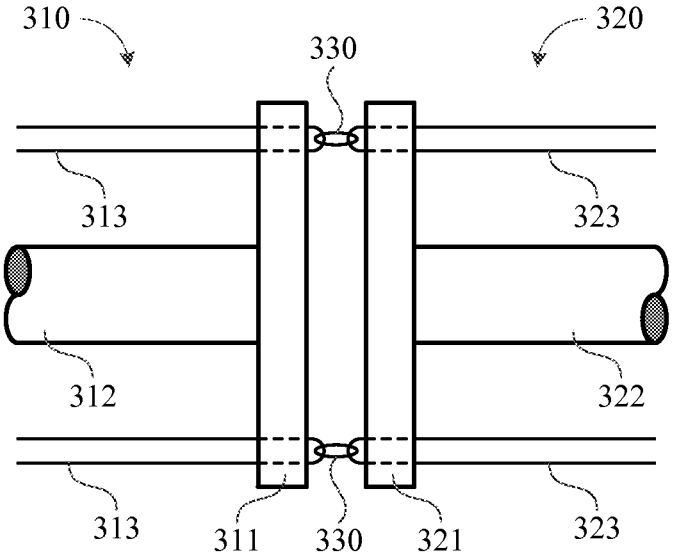
FIGS. 3A and 3B depict illustrative embodiments of assemblies having two reinforcement modules connected together.

Referring now to FIG. 3A, depicted is an illustrative embodiment of an assembly having two reinforcement modules 310 and 320 connected together. Reinforcement module 310 includes an endplate 311, a spacing member 312, and wires 313. Reinforcement module 310 can also include a second endplate which is not shown. In the region where wires 313 loop around endplate 311, there may be some separation between the loop of wires 313 and endplate 311. The separation may be particularly noticeable with the use of certain wires or wire materials, such as high tensile strength wires. Reinforcement module 320 includes an endplate 321, a spacing member 322, and wires 323. Reinforcement module 320 can also include a second endplate which is not shown. In the region where wires 323 loop around endplate 321, there may be some separation between the loop of wires 323 and endplate 321. Reinforcement modules 310 and 320 can be connected together by one or more links 330. In the embodiment depicted in FIG. 3A, links 330 are each looped through one of wires 313 and through one of wires 323. As depicted, links 330 can be connected to wires 313 and 323 via the separation between loops of wires 313 and 323 and endplates 311 and 321. Links 330 can be any kind of link, such as a chain link, a loop of wire, a carabiner, or the like.

Figure 3B:
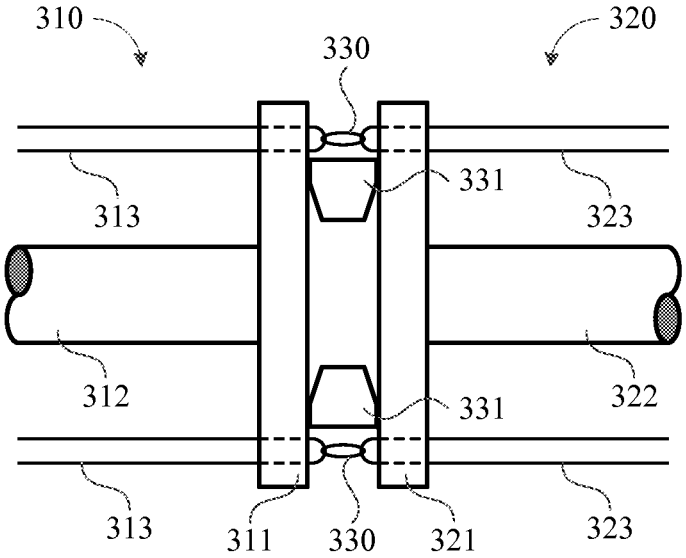

Referring now to FIG. 3B, depicted is another illustrative embodiment of an assembly having reinforcement modules 310 and 320 connected together. In this embodiment, one or more spacers 331 are wedged between endplates 311 and 321. The one or more spacers 331 exert a separating force on endplates 311 and 321, causing the one or more links 330 to be in tension. In this embodiment, the series of wires 313, links 330, and wires 323 are in tension in the assembly. When the assembly in this embodiment is inside of set concrete, a tension load applied to any one of wires 313, links 330, and wires 323 can be spread across the series of wires 313, links 330, and wires 323.

Figure 4:
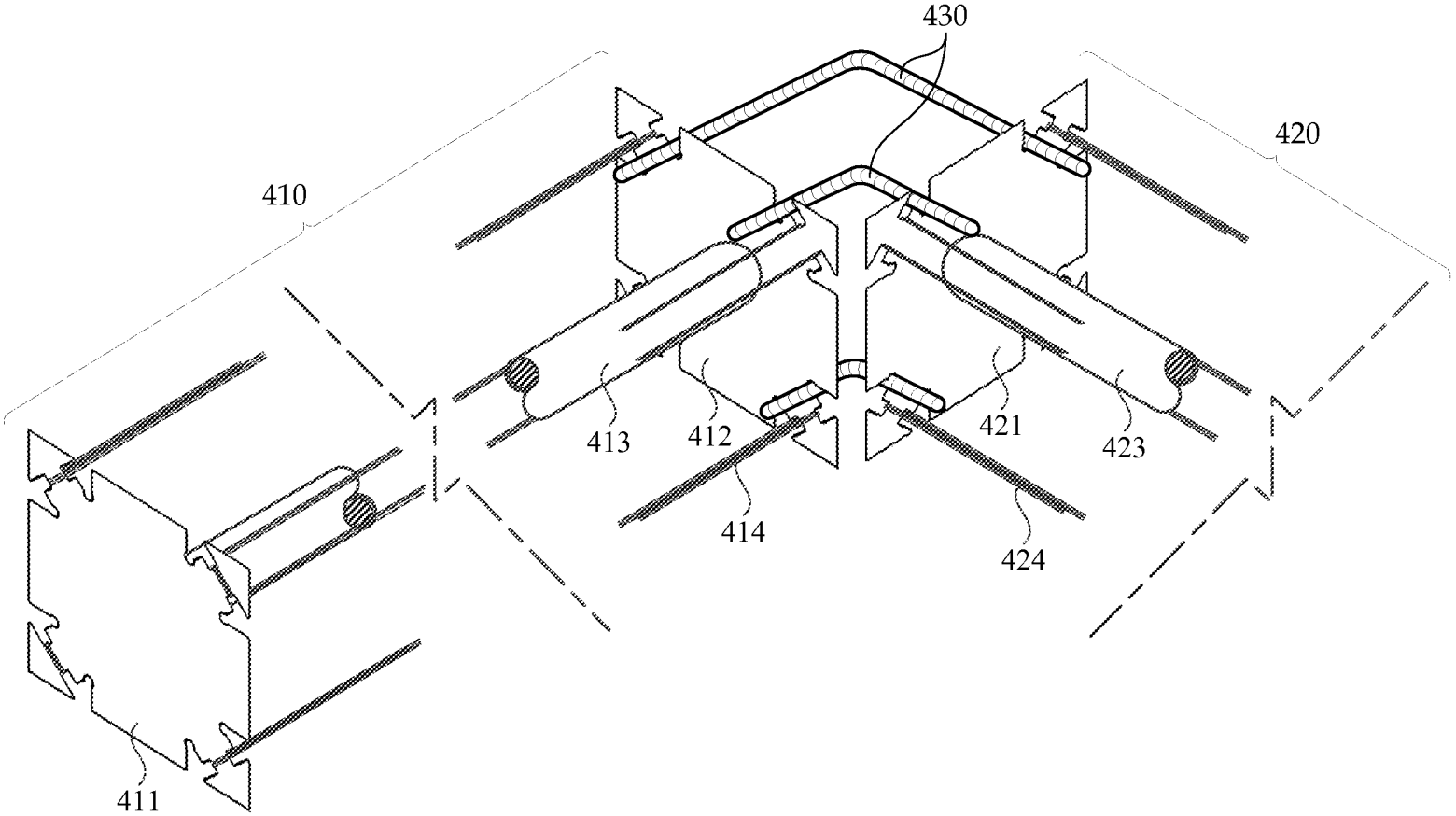
FIG. 4 depicts another illustrative embodiment of an assembly having two reinforcement modules connected together.

Referring now to FIG. 4, depicted is another illustrative embodiment of an assembly having two reinforcement modules 410 and 420 connected together. Reinforcement module 410 includes endplates 411 and 412, a spacing member 413, and wires 414 looped around endplates 411 and 412. Reinforcement module 410 is depicted as being cut through the middle to indicate that module 410 can be of any length. Reinforcement module 420 includes an endplate 421, a spacing member 423, and wires 424 looped around endplate 421. Reinforcement module 420 can also include a second endplate which is not shown. Reinforcement modules 410 and 420 can be connected together by one or more links 430. In the embodiment depicted in FIG. 4, links 430 are reinforcement bars that are connected at one end to endplate 412 of reinforcement module 410 and connected at another end to endplate 421 of reinforcement module 420. Endplate 412 and endplate 421 can include reinforcement bar notches which may be configured to hold one or more reinforcement bars 430.

The use of reinforcement bars as links between reinforcement modules may be advantageous in situations where endplates of neighboring reinforcement modules are not substantially parallel. In the embodiment depicted in FIG. 4, endplate 412 and endplate 421 are not substantially parallel. In one example, a trench may be dug for footings around the edges of an area for a concrete slab foundation. At the corners of the area for the concrete slab foundation, the trench may have an angle that is substantially perpendicular. Reinforcement module 410 and reinforcement module 420 may be placed in the trench on either side of a corner, and reinforcement bars 430 can connect reinforcement module 410 and reinforcement module 420 through the corner.

In the embodiment depicted in FIG. 4, spacing members 413 and 423 are hollow. In certain applications, the space inside of spacing members 413 and 423 may not need to be filled with concrete. This may the case where it is anticipated that the space inside of spacing members 413 and 423 will be subject to little or no compression forces. If the space inside of spacing members 413 and 423 does not need to be filled with concrete, it may be advantageous for spacing members 413 and 423 to not be filled with concrete during the concrete pour. If a spacing member is not filled with concrete, the amount of concrete needed for a concrete pour will be less than if a spacing member is filled with concrete. In some embodiments, the size of the spacing member can be chosen to reduce the amount of concrete needed for a concrete pour (e.g., by choosing a larger size for the spacing member). In other applications, the space inside of spacing members 413 and 423 may need to be filled with concrete. In such a case, holes (not depicted in FIG. 4) can be created in or along the sides of spacing members 413 and 423 prior to the concrete pour. Holes in or along the sides of spacing members 413 and 423 can permit concrete to flow into the space inside of spacing members 413 and 423 when the concrete is poured.

Figure 5:
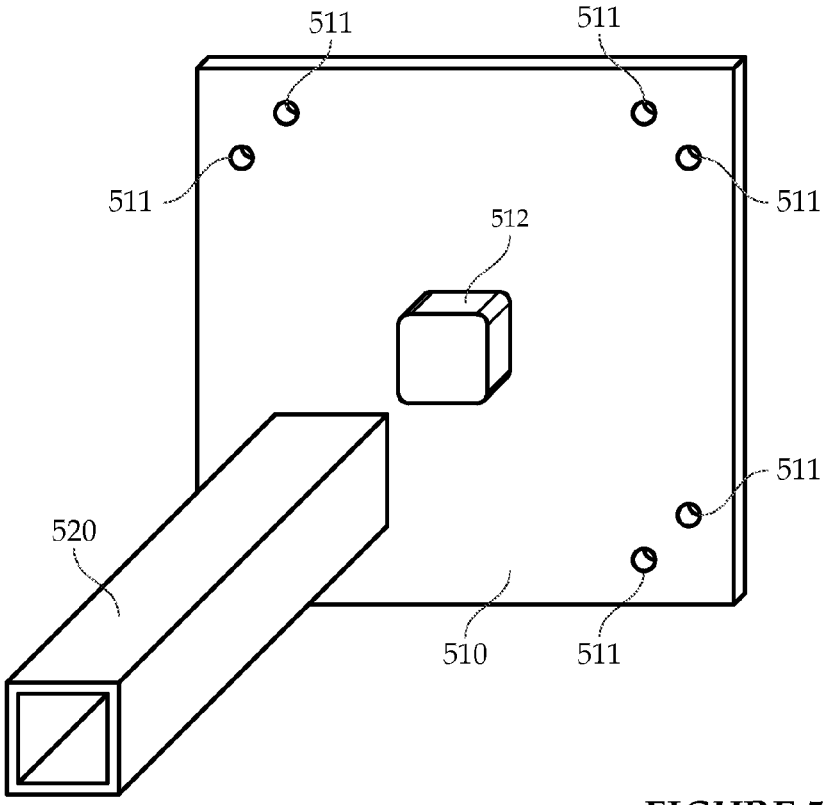
FIG. 5 depicts an illustrative embodiment of an endplate with a locating feature.

Referring now to FIG. 5, depicted is an illustrative embodiment of an endplate 510 with a locating feature 512. Endplate 510 includes notches 511, which are circular holes in the embodiment depicted in FIG. 5. Endplate 510 also includes a locating feature 512, which is depicted as a protrusion. Locating feature 512 may take other forms such as a multiple number of protrusions, one or more fasteners, a contour in the surface of endplate 510, an indentation in the surface of endplate 510, or the like. Locating feature 512 can aid in locating a spacing member 520 at a particular location on endplate 510. During fabrication of a reinforcement module, locating feature 512 can resist any movement of endplate 510 relative to spacing member 520 while wires are looped around endplate 510 and another endplate. Locating feature 512 can also resist any movement of endplate 510 relative to spacing member 520 while reinforcement module is handled, while reinforcement module is placed in a concrete pour area, while concrete is poured in the concrete pour area, and/or while concrete cures in the concrete pour area.

Figure 6:
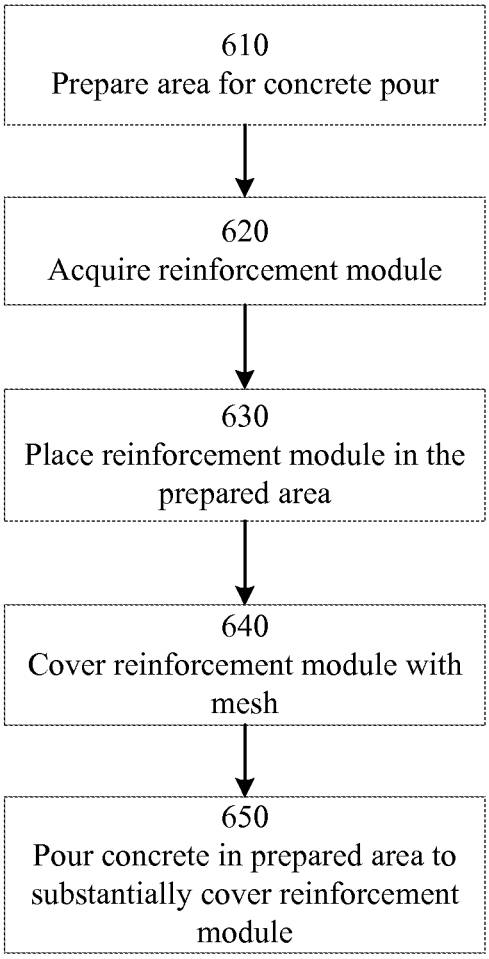
FIG. 6 depicts an illustrative embodiment of a process of preparing for and pouring concrete.

Referring now to FIG. 6, depicted is an illustrative embodiment of a process of preparing and pouring concrete. Example processes may include one or more operations, functions or actions as illustrated by one or more of blocks 610, 620, 630, 640, and/or 650.

An example process may begin at block 610 (Prepare an area for a concrete pour). Preparing an area for a concrete pour can include any or all of digging a trench, leveling ground, constructing concrete molding, and the like. Block 610 may be followed by block 620 (Acquire reinforcement module). The reinforcement module can include endplates, a spacing member, and wires looped around the endplates. The reinforcement module may be acquired as a complete, off-the-shelf product, or it may be acquired by constructing the reinforcement module at the location of the prepared area. The sizes of the endplates and the spacing member may be chosen based on the size of the particular prepared area, based on a standard trench size, based on an amount of concrete to be saved with a hollow spacing member, or based on any other design consideration. Block 620 may be followed by block 630 (Place reinforcement module in the prepared area). Placing the reinforcement module into the prepared area may include connecting the reinforcement module to another reinforcement module with one or more links, placing the reinforcement module into a particular location or position within the prepared area, or the like. Block 630 may optionally be followed by block 640 (Cover reinforcement module with mesh). Although covering the reinforcement module with a mesh is not necessary (i.e., optional), a mesh cover can add stability to the reinforcement module and to any assembly of connected reinforcement modules during the concrete pour. Block 640 may be followed by block 650 (Pour concrete in prepared area to substantially cover reinforcement module). Once the reinforced module is placed in the prepared area and optionally covered with a mesh, concrete may be poured into the prepared area to substantially cover the reinforcement module as desired.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A reinforcement module comprising:

a first endplate having a first plurality of notches;

a second endplate having a second plurality of notches;

a spacing member having a first end and a second end, wherein the first end is in contact with the first endplate and the second end is in contact with the second endplate; and a plurality of wires, at least one of the plurality of wires looped around at least one of the first plurality of notches and at least one of the second plurality of notches, the plurality of wires is in tension between the first endplate and the second endplate that are maintained apart from each other by the spacing member, the plurality of wires including one or more friction elements, wherein the first plurality of notches comprises at least a first pair of corresponding notches and at least a second pair of corresponding notches, the at least first pair of corresponding notches differently shaped than the at least second pair of corresponding notches.

2. The reinforcement module of claim 1, wherein the spacing member is hollow.

3. The reinforcement module of claim 2, wherein the spacing member comprises a plurality of holes.

4. The reinforcement module of claim 1, wherein the plurality of wires comprises high-tensile wire.

5. The reinforcement module of claim 1, wherein the first endplate comprises a first locating feature configured to position the first end of the spacing member, and wherein the second endplate comprises a second locating feature configured to position the second end of the spacing member.

6. The reinforcement module of claim 1, wherein the first endplate and the second endplate have a predetermined size based on the size of a trench.

7. The reinforcement module of claim 1, wherein the at least one of the first plurality of notches comprises a wire notch and a reinforcement bar notch.

8. An assembly, comprising:

a first reinforcement module comprising:

a first endplate, a second endplate, a first spacing member, and a first plurality of wires, wherein the first endplate is separated from the second endplate by the first spacing member, and wherein the first plurality of wires is in tension between the first endplate and the second endplate;

a second reinforcement module comprising:

a third endplate, a fourth endplate, a second spacing member, and a second plurality of wires, wherein the third endplate is separated from the fourth endplate by the second spacing member, and wherein the second plurality of wires being in tension between the third endplate and the fourth endplate;

at least one link connecting the first reinforcement module to the second reinforcement module; and one or more spacers positioned between the second endplate and the third endplate, wherein the one or more spacers exert a separating force on the second endplate and the third endplate and to cause the at least one link to be in tension.

9. The assembly of claim 8, wherein the at least one link comprises at least one reinforcement bar, and wherein the at least one reinforcement bar is routed through at least one notch of the second endplate and routed through at least one notch of the third endplate.

10. The assembly of claim 8, wherein the at least one link is located between the second endplate and the third endplate, and wherein the at least one link is looped through at least one of the first plurality of wires and through at least one of the second plurality of wires.

11. The assembly of claim 8, wherein the second endplate of the first reinforcement module is substantially perpendicular to the third endplate of the second reinforcement module.

12. The assembly of claim 11, wherein the at least one link comprises a plurality of reinforcement bars.

13. The assembly of claim 12, wherein at least one of the plurality of reinforcement bars pass through a reinforcement bar notch of the second endplate and pass through a reinforcement bar notch of the third endplate.

14. A method, comprising:

preparing an area for a concrete pour;

acquiring a reinforcement module, the reinforcement module comprising:

a first endplate having a first plurality of notches, a second endplate having a second plurality of notches, a spacing member having a first end and a second end, wherein the first end is in contact with the first endplate and the second end is in contact with the second endplate, and a plurality of wires, at least one of the plurality of wires being looped around at least one of the first plurality of notches and around at least one of the second plurality of notches;

placing the reinforcement module in the area;

connecting the reinforcement module to a second reinforcement module with at least one link;

inserting one or more spacers positioned between the first endplate of the reinforcement module and an endplate of the second reinforcement module, the one or more spacers exerting a separating force on the first endplate of the reinforcement module and the endplate of the second reinforcement module to cause the at least one link to be in tension; and pouring the concrete in the area to substantially cover the reinforcement module.

15. The method of claim 14, wherein preparing the area comprises digging a trench.

16. The method of claim 14, wherein acquiring the reinforcement module comprises:

selecting the reinforcement module based on a size of the area and a size of the first and second endplates.

17. The method of claim 14, further comprising:

placing the second reinforcement module in the area; and connecting the reinforcement module to the second reinforcement module.

18. The method of claim 17, wherein connecting the reinforcement module to the second reinforcement module with the at least one link comprises looping the at least one link through one of the plurality of wires of the reinforcement module and through a wire of the second reinforcement module.

19. A reinforcement module comprising:

a first endplate having a first plurality of notches;

a second endplate having a second plurality of notches;

a spacing member having a first end and a second end, wherein the spacing member includes a plurality of holes, the first end is in contact with the first endplate and the second end is in contact with the second endplate; and a plurality of wires, at least one of the plurality of wires looped around at least one of the first plurality of notches and at least one of the second plurality of notches, the plurality of wires being in tension between the first endplate and the second endplate that are maintained apart from each other by the spacing member, the plurality of wires includes one or more friction elements, wherein the friction elements comprise barbs, surface roughness, or a combination thereof, and wherein the first plurality of notches comprises at least a first pair of corresponding notches and at least a second pair of corresponding notches, the at least first pair of corresponding notches differently shaped than the at least second pair of corresponding notches.

20. The reinforcement module of claim 19, wherein the spacing member is hollow.

21. The reinforcement module of claim 19, wherein the plurality of wires comprises high-tensile wire.

22. The reinforcement module of claim 19, wherein the first endplate comprises a first locating feature configured to position the first end of the spacing member, and wherein the second endplate comprises a second locating feature configured to position the second end of the spacing member.

23. The reinforcement module of claim 19, wherein the first endplate and the second endplate have a predetermined size based on the size of a trench.

24. The reinforcement module of claim 19, wherein at least one of the first plurality of notches comprises a wire notch and a reinforcement bar notch.

* * * * *